United States Patent [19]

Hunter et al.

[11] Patent Number: 5,067,729

[45] Date of Patent: Nov. 26, 1991

[54] BLOCK STACKING GAME APPARATUS

[76] Inventors: Gary W. Hunter, 1603 Landing Ct., Woodstock, Ga. 30188; Robert L. Leeper, 2327 Dayron Cir., Marietta, Ga. 30062

[21] Appl. No.: 597,515

[22] Filed: Oct. 15, 1990

[51] Int. Cl.[5] ..... A63F 9/00

[52] U.S. Cl. ..... 273/450; 446/122

[58] Field of Search ..... 273/19 F, 450; 446/85, 446/117, 118, 122

[56] References Cited

U.S. PATENT DOCUMENTS

| | | | |
|---|---|---|---|
| 3,460,831 | 8/1969 | Glass et al. | 273/19 F |
| 3,899,169 | 8/1975 | Rhodes et al. | 446/85 X |
| 4,219,961 | 9/1980 | Stiles | 446/85 |
| 4,753,622 | 6/1988 | Nakama | 446/85 |
| 4,902,010 | 2/1990 | Davis et al. | 273/1 GF |

FOREIGN PATENT DOCUMENTS

| | | | |
|---|---|---|---|
| 875467 | 5/1953 | Fed. Rep. of Germany | 446/85 |
| 3704105 | 11/1988 | Fed. Rep. of Germany | 446/122 |
| 371638 | 4/1932 | United Kingdom | 446/122 |
| 2068747 | 8/1981 | United Kingdom | 273/1 GF |

*Primary Examiner*—Paul E. Shapiro

*Attorney, Agent, or Firm*—Leon Gilden

[57] ABSTRACT

A game apparatus including a plurality of block members, wherein each block member is defined by an equal predetermined length. The block members are defined by a trapezoidal cross-sectional configuration, wherein both sides are of differing lengths. An elongate slot is directed through a plurality of the side walls arranged parallel to the remaining side walls. The game permits stacking of the blocks until a player effects a tumbling of the formed stack upon which a point total is awarded to a preceding opposing player.

2 Claims, 4 Drawing Sheets

PRIOR ART 16
19
E
18
10
D
C
19
15
18
B
15
17
14
A
15
19
17
13

BLOCK STACKING GAME APPARATUS

BACKGROUND OF THE INVENTION

1. Field of the Invention

The field of invention relates to block stacking games, and more particularly pertains to a new and improved block stacking game apparatus wherein the same provides a finite series of block members to effect stacking of a tower by use of the block members.

2. Description of the Prior Art

Various block stacking games have been utilized in the prior art. Such block stacking games may be found in U.S. Pat. No. 4,293,128 to Epel wherein a set of indicia marked blocks are arranged for stacking by players in alternating turns until the stack tumbles.

U.S. Pat. No. 4,877,407 to Du Pont, et al. provides blocks with a center gravity and various positions relative to each of the blocks to effect a various pattern in a block stacking arrangement.

U.S. Pat. No. 4,303,240 to Ellman wherein blocks are stacked upon a table, and wherein the table is repositioned in a circular manner relative to a support base.

U.S. Pat. No. 4,522,393 to Dunn sets forth a block removal and balancing game wherein a stack of blocks are provided and individual blocks are removed until the stack tumbles.

U.S. Pat. No. 3,955,814 to Shallenberger sets forth a block balancing game with elongate bodies having rounded protrusions at one end and socket at the other end to permit an assemblage and stacking of the array of blocks.

As such, it may be appreciated that there continues to be a need for a new and improved block stacking game apparatus which addresses both the problems of ease of use as well as effectiveness in construction in permitting assemblage of the blocks in a predetermined array and in this respect, the present invention substantially fulfills this need.

SUMMARY OF THE INVENTION

In view of the foregoing disadvantages inherent in the known types of block stacking games now present in the prior art, the present invention provides a block stacking game apparatus wherein the same provides blocks of trapezoidal cross-sectional configuration of equal length to effect a stacking procedure in alternating turns by players until the stack tumbles. As such, the general purpose of the present invention, which will be described subsequently in greater detail, is to provide a new and improved block stacking game apparatus which has all the advantages of the prior art block stacking games and none of the disadvantages.

To attain this, the present invention provides a game apparatus including a plurality of block members, wherein each block member is defined by an equal predetermined length. The block members are defined by a trapezoidal cross-sectional configuration, wherein both sides are of differing lengths. An elongate slot is directed through a plurality of side walls arranged parallel to the remaining side walls. The game permits stacking of the blocks until a player effects a tumbling of the formed stack upon which a point total is awarded to a preceding opposing player.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved block stacking game apparatus which has all the advantages of the prior art block stacking games and none of the disadvantages.

It is another object of the present invention to provide a new and improved block stacking game apparatus which may be easily and efficiently manufactured and marketed.

It is a further object of the present invention to provide a new and improved block stacking game apparatus which is of a durable and reliable construction.

An even further object of the present invention is to provide a new and improved block stacking game apparatus which is susceptible of a low cost of manufacture with regard to both materials and labor, and which accordingly is then susceptible of low prices of sale to the consuming public, thereby making such block stacking game apparatus economically available to the buying public.

Still yet another object of the present invention is to provide a new and improved block stacking game apparatus which provides in the apparatuses and methods of the prior art some of the advantages thereof, while simultaneously overcoming some of the disadvantages normally associated therewith.

Still another object of the present invention is to provide a new and improved block stacking game apparatus wherein the same permits assemblage of blocks of trapezoidal cross-sectional configuration in a stacked array to construct a tower prior to tumbling of the tower by the stacking of blocks in alternating arrangement by various players.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
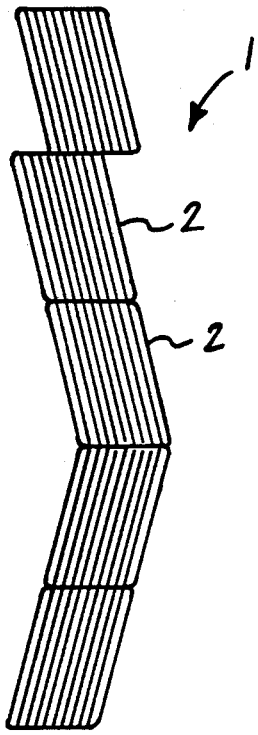
FIG. 1 is an orthographic view, taken in elevation, of a prior art block stacking game arrangement.

With reference now to the drawings, and in particular to FIGS. 1 to 9 thereof, a new and improved block stacking game apparatus embodying the principles and concepts of the present invention and generally designated by the reference numeral 10 will be described.

Figure 2:
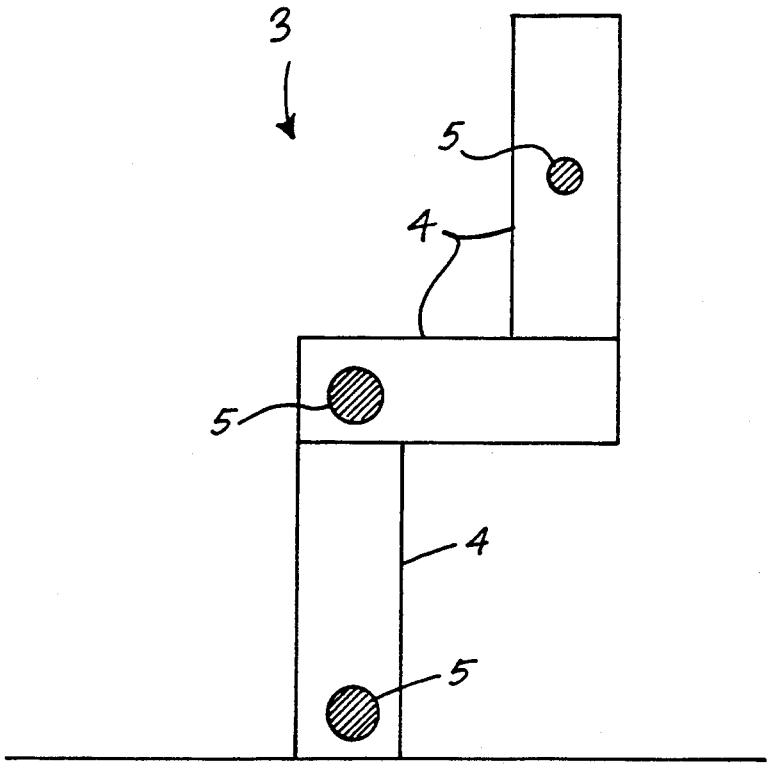
PRIOR ART FIG 2
FIG. 2 is an orthographic view, taken in elevation, of a further prior art block stacking game arrangement.
Figure 3:
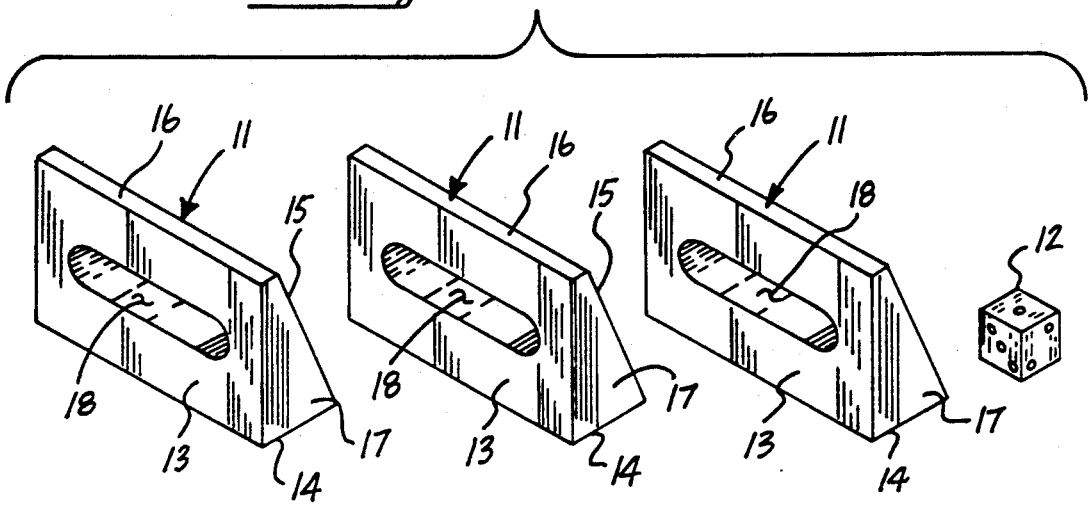
FIG. 3 is an isometric illustration of a plurality of blocks and chance device utilized by the instant invention.
Figure 4:
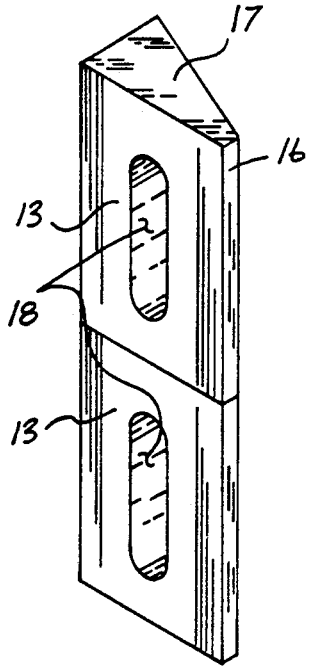
FIG. 4 is an isometric illustration of a plurality of blocks in a stacked relationship.

FIG. 1 illustrates a prior art block stacking arrangement 1, wherein a series of blocks 2 each include indicia to effect gauging of the blocks in assisting individuals in a stacking procedure in a manner as set forth in U.S. Pat. No. 4,293,128. FIG. 2 illustrates a further block assemblage 3, wherein the blocks 4 include centers of mass 5 to effect repositioning of centers of gravity to assist in repositioning of the blocks relative to their centers of gravity, in a manner as set forth in U.S. Pat. No. 4,877,407.

Figure 5:
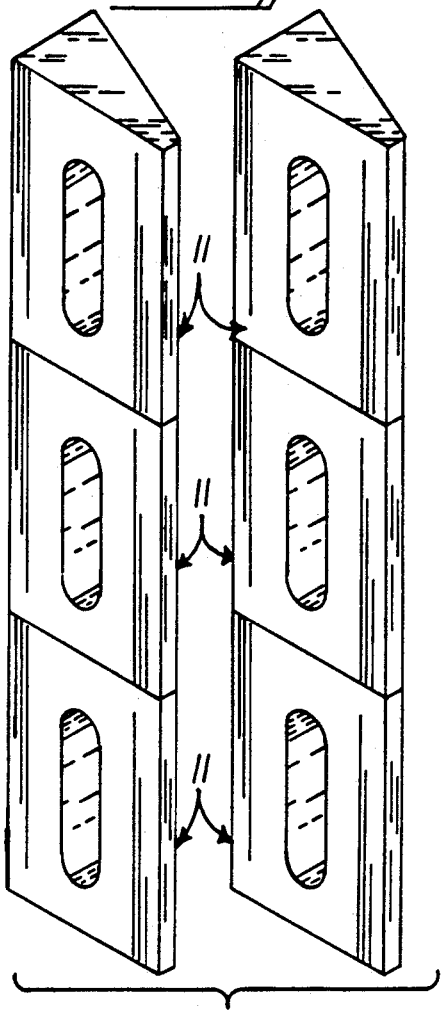
FIG. 5 is an isometric illustration of a further plurality of the blocks in a variation of a stacked arrangement to effect construction of a tower.
Figure 6:
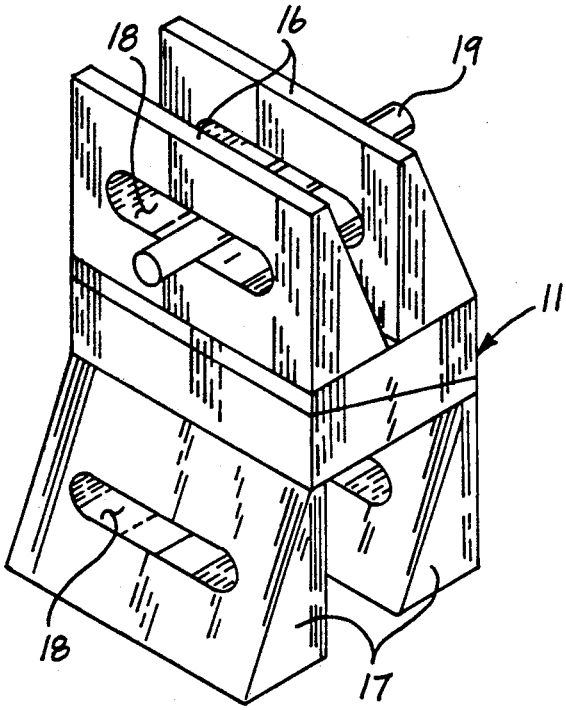
FIG. 6 is an isometric illustration of the instant invention utilizing a dowel rod member.
Figure 7:
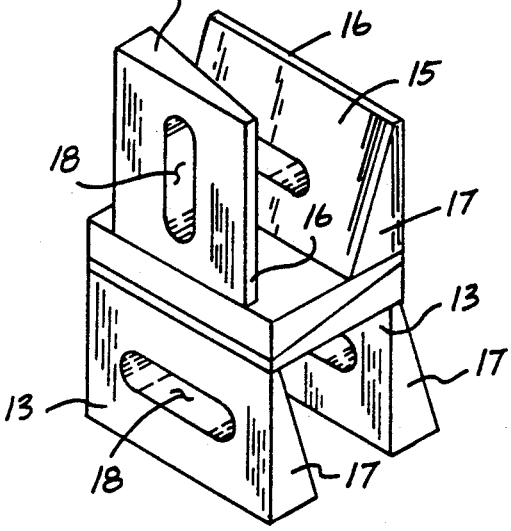
FIG. 7 is an isometric illustration of the blocks stacked in a regular array.

More specifically, the block stacking game apparatus 10 of the instant invention essentially comprises a plurality of block members 11, each of a predetermined length. A six-sided die member 12 is utilized as a chance member in use of the game apparatus. The die member 12 is sequentially rolled by the various players, with the player rolling the highest number proceeding first. Each player alternately rolls the die member 12 to determine the number of block members 11 corresponding to the number rolled that must be stacked on a one-at-a-time basis. A sequential player then rolls the die member 12 to similarly determine the number of game pieces to stack upon those already arranged in a predetermined array or tower, as exemplified by FIG. 4 for example, wherein a first player may roll a two and two block members 11 are then stacked. The arbitrary point total is determined, such as 100, with the first player to attain 100 points as being declared a winner. If block members 11 are stacked in parallel towers to erect a single tower, they must be stacked in an equal height arrangement, such as illustrated in FIG. 5, as opposed to the relationship as illustrated in FIG. 7, illustrating on an equal stacking height by the top layer of block members.

Each block member includes a first side wall 13 defined by a first width and arranged orthogonally relative to a base or second side wall 14 defined by a second width. A third side wall 15 of a third width is arranged at a generally acute included angle relative to the first and second side walls. A fourth side wall 16 is defined and parallel to the first side wall 13. Thusly, each cross-sectional configuration of each block is equal and defined by a trapezoidal cross-sectional configuration. Further, the third side wall 15 and the third width is greater than the first width defined by the first side wall 13. Similarly, the first side wall 13 is of a greater width than the second side wall 14 defined by the second width. The second side wall 14 is defined by the second width greater than the fourth width defined by the fourth side wall 16. End walls 17 are arranged orthogonally relative to the side walls and are arranged parallel relative to one another to enhance stacking of the organization. Each block member 11 includes an elongate, enclosed slot 18 through-extending the first and third side walls 13 and 15 with the slot positioned medially and parallel to the second and fourth side walls 14 and 16. The enclosed slot is provided to enhance manual grasping positioning of the organization and for further use with a plurality of elongate dowel rods 19, each of a generally cylindrical and rigid construction.

Figure 8:
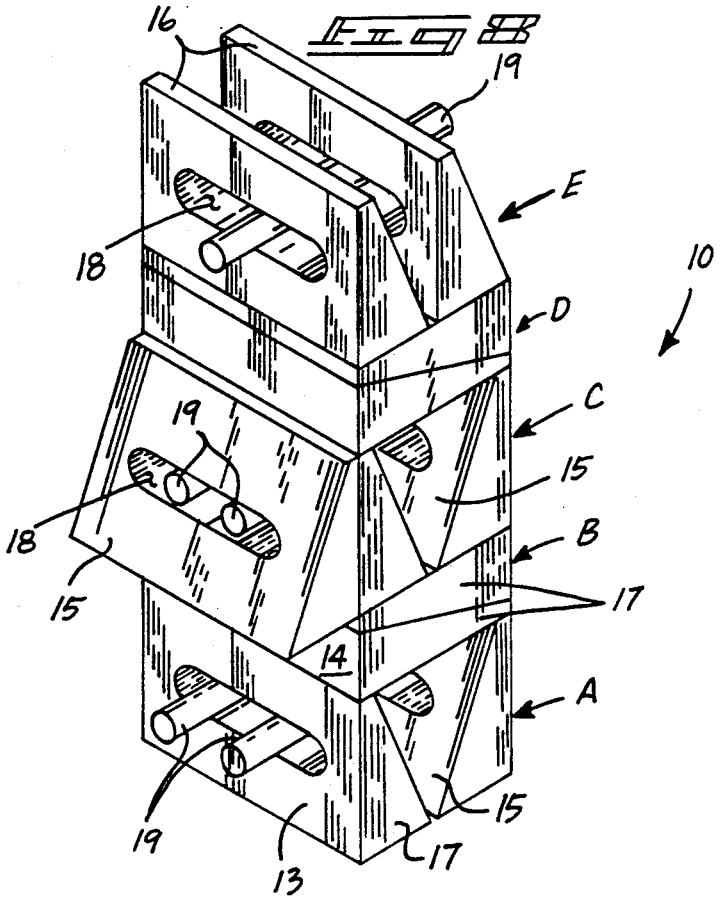
FIG. 8 is an isometric illustration of the instant invention utilizing the dowel rods to effect positioning of additional blocks in a laterally spaced relationship relative to the tower.
Figure 9:
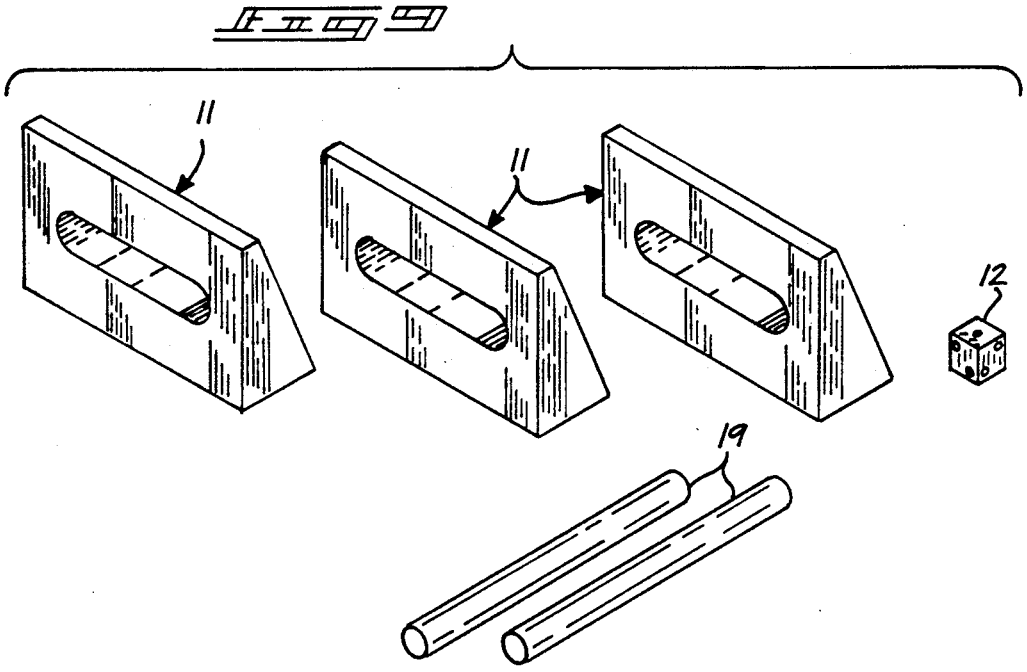
FIG. 9 is an isometric illustration of the instant invention illustrating the various components utilized.

The dowel rods 19 may be used optionally by the players, wherein a player may position a plurality of such dowel rods 19 through the elongate slot 18, with the elongate dowel rods 19 of a length sufficient to permit extension of the dowel rods 19 beyond adjacent slots of a plurality of block members 11. In this manner, a block member 11 may be positioned laterally of an arranged tower, in a manner as illustrated in FIG. 8. FIG. 8 illustrates a first layer "A" of a plurality of blocks, with a second layer "B" of a plurality of blocks, a third layer "C", a fourth layer "D", and a fifth layer "E". It is noted that the third layer "C" includes the plurality of dowel rods 19 extending beyond the enclosed slots to the blocks 11 to permit securement of additional block laterally of the blocks and supported solely by the dowel rods 19. The dowel rods may be further utilized to effect stability in the organization when positioned through adjacent slots of adjacent block members 11. It is further contemplated that when mounting a laterally positioned block, in a manner as illustrated in FIG. 8, a player thusly in using such a block may be awarded a point total for use with such a block when such a block may count as two blocks rather than one in the stacking and positioning of blocks.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to on skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A block stacking game apparatus for stacking of blocks in a balanced relationship relative to one another to define a tower, wherein the apparatus comprises, a plurality of block members, the block members each defined by an equal predetermined length and each defined by a respective identical trapezoidal prism and shape, and a die member to sequentially direct players in stacking of the block members, and wherein each block member includes a first side wall, a second side wall, a third side all, and a fourth wall, the second and fourth side walls arranged parallel relative to one another, and the first side wall defined by a first length, the second side wall defined by a second length, the third side wall defined by a third length, and the fourth side wall defined by a fourth length, wherein the third length is greater than the first length, the first length is greater than the second length, and the second length is greater than the fourth length, and including an elongate enclosed slot directed through the first and third side walls, the enclosed slot of each block member positioned medially and arranged parallel between the second and fourth side walls.

2. An apparatus as set forth in claim 1 including a plurality of dowel rods, wherein the dowel rods are defined by a dowel rod length greater than the predetermined length of the block members, and wherein the dowel rods are arranged for projection through adjacent enclosed slots of adjacent block members for effecting stability of the block members and to further permit mounting of an additional block member upon the dowel rods when directed through the adjacent elongate enclosed slots.

* * * * *